US008834045B2

(12) United States Patent
Yen

(10) Patent No.: US 8,834,045 B2
(45) Date of Patent: Sep. 16, 2014

(54) PRINTER CAPABLE OF PRINTING TWO SURFACES OF A WEB

(75) Inventor: Kai-Chieh Yen, Taipei (TW)

(73) Assignee: HiTi Digital, Inc., Xindian Dist., New Taipei (TW)

( * ) Notice: Subject to any disclaimer, the term of this patent is extended or adjusted under 35 U.S.C. 154(b) by 136 days.

(21) Appl. No.: 13/474,699

(22) Filed: May 17, 2012

(65) Prior Publication Data

US 2013/0133534 A1 May 30, 2013

(30) Foreign Application Priority Data

Nov. 29, 2011 (TW) ..... 100143702 A

(51) Int. Cl.
*B41J 3/60* (2006.01)
*B41J 15/00* (2006.01)

(52) U.S. Cl.
USPC ..... 400/188; 400/614

(58) Field of Classification Search
CPC ..... B41J 15/00; B41J 15/02; B41J 15/04; B41J 3/60
USPC ..... 400/614, 188
See application file for complete search history.

(56) References Cited

U.S. PATENT DOCUMENTS

| | | | | | |
|---|---|---|---|---|---|
| 2,244,809 | A * | 6/1941 | Sloan | 65/308 |
| 4,076,149 | A | 2/1978 | Saxinger | |
| 4,124,132 | A * | 11/1978 | Pennings | 414/403 |
| 4,166,094 | A * | 8/1979 | Froehlich et al. | 73/864.25 |
| 5,615,468 | A * | 4/1997 | Chubbuck | 29/38 C |
| 7,456,629 | B2 * | 11/2008 | Babin et al. | 324/207.25 |
| 8,538,316 | B2 * | 9/2013 | Shigeno et al. | 399/406 |
| 8,540,441 | B2 * | 9/2013 | Noguchi et al. | 400/188 |
| 2003/0194253 | A1 * | 10/2003 | Trovinger | 400/188 |
| 2009/0067911 | A1 * | 3/2009 | Matsuhashi | 400/582 |
| 2011/0135372 | A1 * | 6/2011 | Sato et al. | 400/614 |
| 2011/0211897 | A1 * | 9/2011 | Uchida et al. | 400/614 |

FOREIGN PATENT DOCUMENTS

| | | | | |
|---|---|---|---|---|
| JP | 60156105 A | * | 8/1985 | G05B 19/18 |
| JP | 2004340609 A | * | 12/2004 | B62D 1/16 |
| TW | 156615 | | 4/1991 | |
| TW | 518286 | | 1/2003 | |
| TW | 200711871 | | 4/2007 | |
| TW | 200924994 | | 6/2009 | |

* cited by examiner

*Primary Examiner* — Nguyen Ha
(74) *Attorney, Agent, or Firm* — Winston Hsu; Scott Margo

(57) ABSTRACT

A printer capable of printing two surfaces of a medium is disclosed in the present invention. The printer includes a base, a holder rotatably disposed on the base for holding webs, and a rotary mechanism for rotating the holder relative to the base. The rotary mechanism includes a wheel disposed on the holder, and a gear crank disposed on the base. A plurality of slots is formed on the wheel, and the gear crank includes an actuating pin. The actuating pin can slide into one of the slots when the gear crank rotates, so as to rotate the wheel, and the holder can rotate relative to the base.

9 Claims, 4 Drawing Sheets

PRINTER CAPABLE OF PRINTING TWO SURFACES OF A WEB

BACKGROUND OF THE INVENTION

1. Field of the Invention

The present invention relates to a printer capable of printing two surfaces of a web, and more particularly, to a printer utilizing a rotary mechanism to rotate a web for two-surface print.

2. Description of the Prior Art

Generally, a conventional printer capable of printing two surfaces of a web can utilize two print head respectively disposed by two sides of the web, so as to print ink on the surfaces of the web. The other conventional printer capable of printing two surfaces of a web can change an advancing path of the web by a rotary mechanism, so as to print ink on the different surfaces of the web by one print head. However, the conventional printers have drawbacks of complicated structures, huge volume and low print quality. Design of a printer capable of printing two surfaces of the web on the premise that the printer includes one print head with identical advancing paths for keeping preferable print quality is an important issue in the mechanism industry.

SUMMARY OF THE INVENTION

The present invention provides printer utilizing a rotary mechanism to rotate a web for two-surface print for solving above drawbacks.

According to the claimed invention, a printer includes a base, a holder rotatably disposed on the base for holding a web, and a rotary mechanism for rotating the holder relative to the base, so as to print two surfaces of the web. The rotary mechanism includes a wheel disposed on the holder, and a plurality of slots is formed on the wheel. The rotary mechanism further includes a gear crank disposed on the base. The gear crank includes an actuating pin, and the actuating pin slides into one of the slots when the gear crank rotates, so as to rotate the wheel.

According to the claimed invention, the wheel is a Geneva wheel disposed on a bottom of the holder.

According to the claimed invention, the rotary mechanism further includes a first sensor, an auxiliary gear disposed on the base and engaged with the gear crank, and a first trigger pin disposed on the auxiliary gear. The first sensor is triggered to generate a controlling signal for stopping the gear crank by the first trigger pin when the auxiliary gear rotates at a predetermined angle.

According to the claimed invention, a gear ratio of the auxiliary gear to the gear crank is 1 to 1.

According to the claimed invention, the wheel includes a sunken structure, the gear crank further includes a prominent arc structure, and the prominent arc structure slides relative to the sunken structure.

According to the claimed invention, the rotary mechanism further includes a second sensor disposed on the base, and a second trigger pin disposed on a bottom of the holder. The second sensor is triggered to generate a prompting signal with state information of the holder by the second trigger pin when the holder rotates at a predetermined angle.

According to the claimed invention, the rotary mechanism further includes a plurality of second sensors separately disposed on the base, and the second trigger pin triggers the corresponding second sensor to generate the prompting signal with the state information of the holder.

According to the claimed invention, the printer further includes an advance mechanism disposed above the holder for advancing the web. The advance mechanism includes a pinch roller and a feed roller, and a tangent line between the pinch roller and the feed roller aligns with a rotary center of the holder.

According to the claimed invention, the first sensor and the second sensor are optical interrupters.

The printer of the present invention utilizes the rotary mechanism having the Geneva wheel to adjust the rotation angle of the holder relative to the base, so as to reverse the web for the two-surface print. In addition, the rotary mechanism of the present invention can utilize the arc structure of the gear crank to tightly contact the sunken structure of the wheel for increasing stability of the holder relative to the base, and can further utilize an assembly of the sensor and the trigger pin to detect the rotation angle of the holder, so as to provide functions of auto rotation control and active state information prompt.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
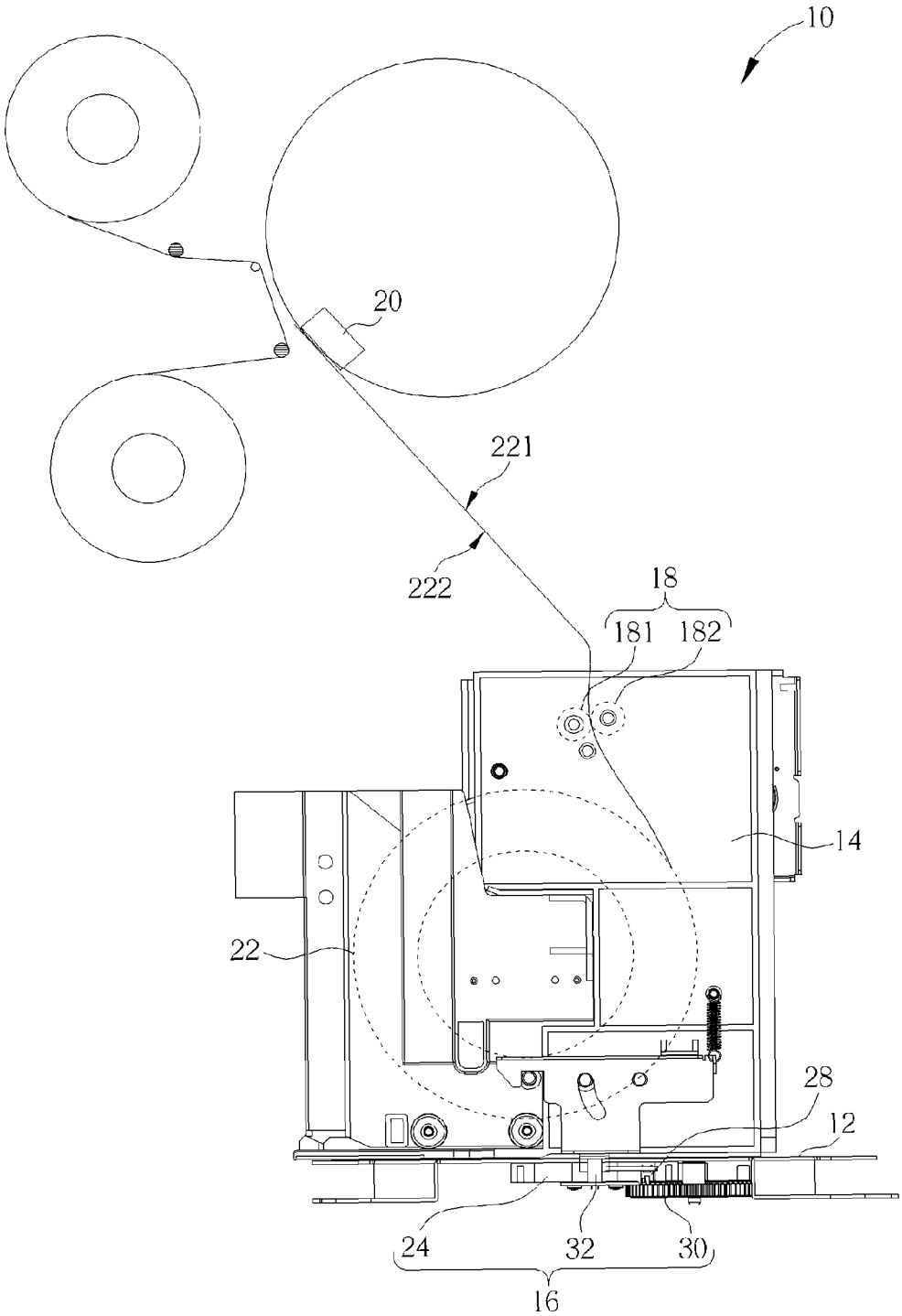
FIG. 1 is a diagram of a printer in a lateral view according to an embodiment of the present invention.
Figure 2:
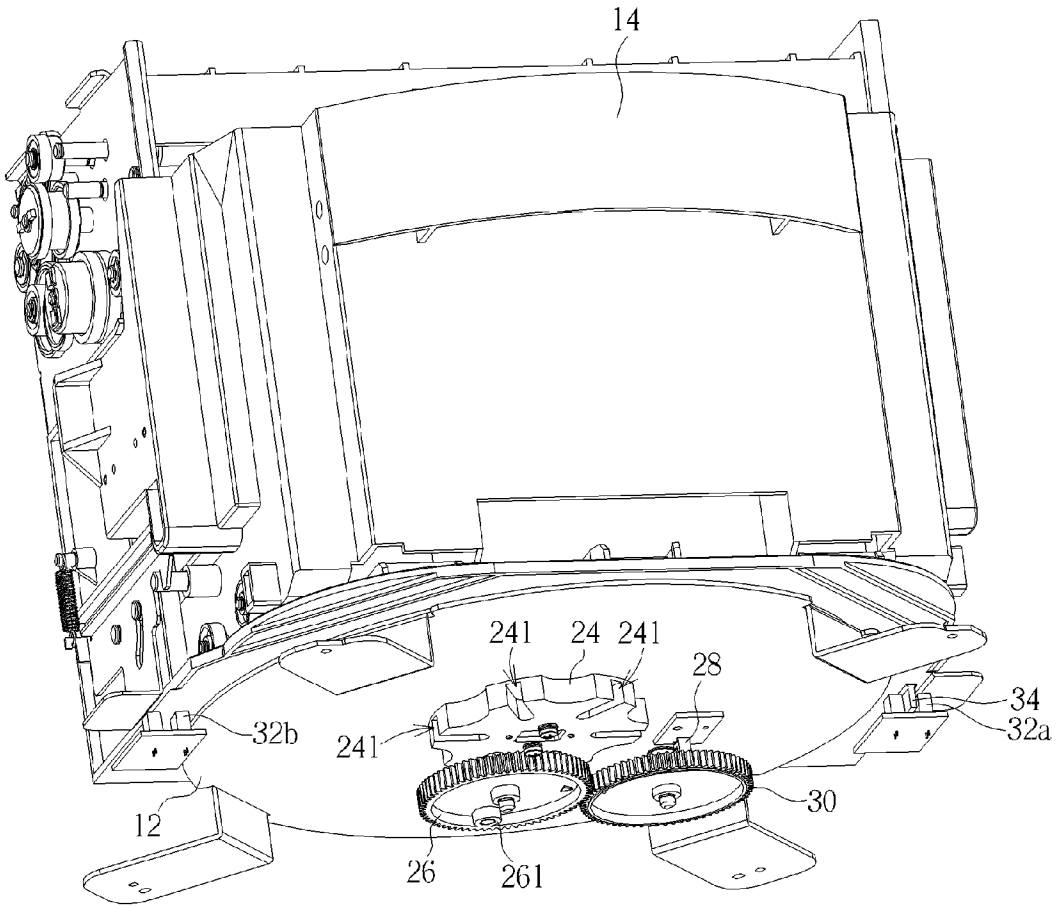
FIG. 2 is a diagram of a part of the printer according to the embodiment of the present invention.

Please refer to FIG. 1 and FIG. 2. FIG. 1 is a diagram of a printer 10 in a lateral view according to an embodiment of the present invention. FIG. 2 is a diagram of a part of the printer 10 according to the embodiment of the present invention. The printer 10 includes a base 12, a holder 14 rotatably disposed on the base 12, a rotary mechanism 16 for rotating the holder 14 relative to the base 12, an advance mechanism 18 disposed above the holder 14, and a print mechanism 20 disposed above the advance mechanism 18. The holder 14 can be for holding a web 22. The advance mechanism 18 can advance a piece of paper from the web 22 to the print mechanism 20. The rotary mechanism 16 rotates the holder 14 relative to the base 12, so as to reverse the piece of paper from the web 22, which means the advance mechanism 18 can advance a first surface 221 or a second surface 222 of the web 22 to the print mechanism 20 according to actual demand for two-surface print.

Figure 3:
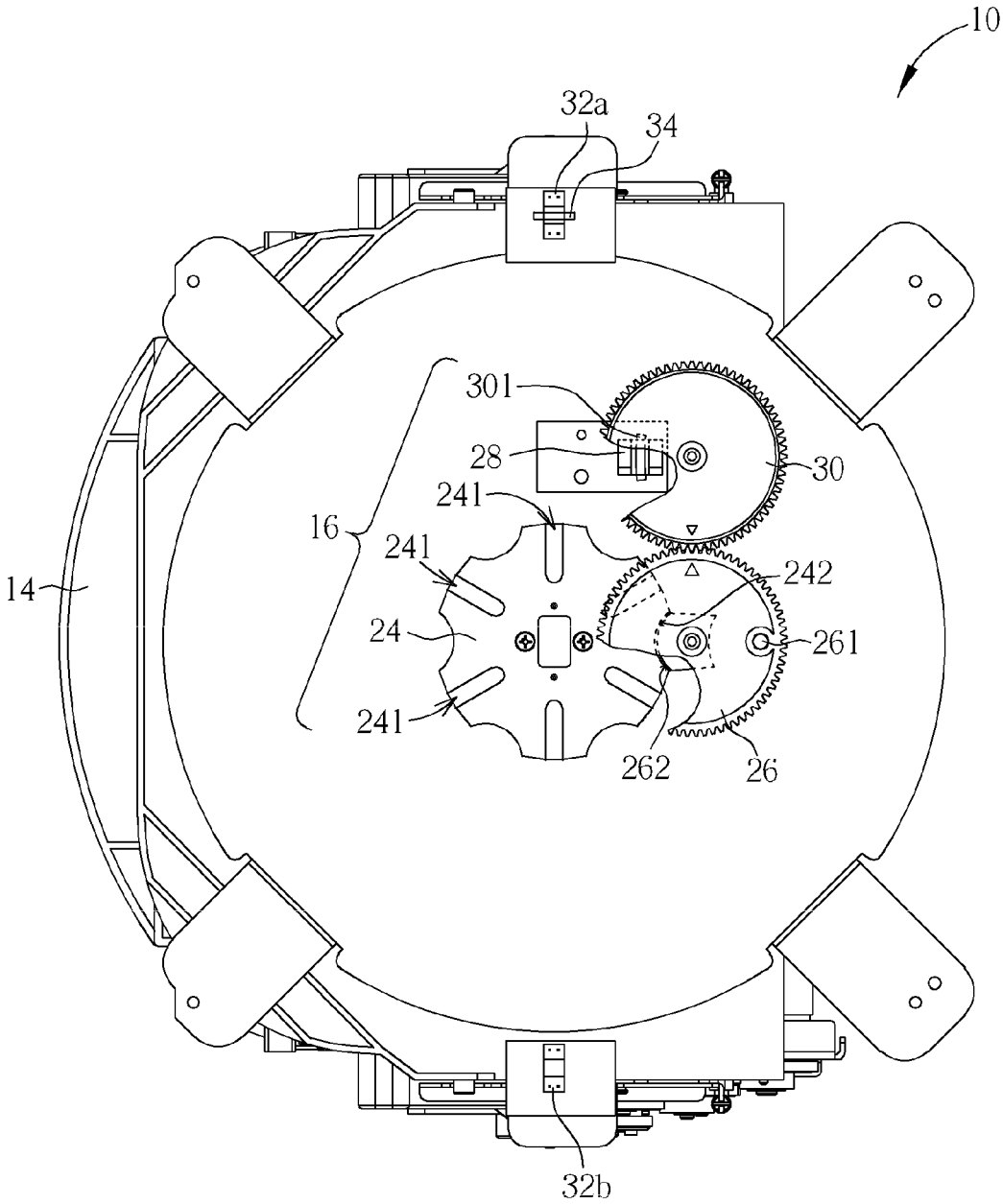
FIG. 3 is a diagram of the part of the printer in an upward view according to the embodiment of the present invention.

Please refer to FIG. 2 and FIG. 3. FIG. 3 is a diagram of the part of the printer 10 in an upward view according to the embodiment of the present invention. The rotary mechanism 16 of the printer 16 includes a wheel 24 disposed on the holder 14, and a gear crank 26 disposed on the base 12. A plurality of slots 241 can be formed on the wheel 24, and the gear crank 26 includes an actuating pin 261. When the gear crank 26 rotates, the actuating pin 261 can slide into one of the slots 241 on the wheel 24 in a predetermined period and drive the wheel 24 to rotate, so that the holder 14 can rotate with the wheel 24 relative to the base 12. The wheel 24 can be a Geneva wheel disposed on a bottom of the holder 14. In the embodiment of the present invention, the wheel 24 (the Geneva wheel) includes six slots 241 separately formed around a surface of the wheel 24, so the gear crank 26 can drive the wheel 24 to 60 degrees when rotating a round. An amount of the slots 241 and rotation angles of the gear crank 26 relative to the wheel 24 are not limited to the above-mentioned embodiment, and depend on design demand.

The rotary mechanism 16 can further include a first sensor 28 and an auxiliary gear 30. The auxiliary gear 30 can be disposed on the base 12 and engaged with the gear crank 26. The rotary mechanism 16 can further include a first trigger pin 301 disposed on the auxiliary gear 30. The first trigger pin 301 can be a protrusion, and the first sensor 28 can be an optical interrupter. The first trigger pin 301 can trigger the first sensor 28 when the auxiliary gear 30 rotates at a predetermined angle, such as three circles, and the first sensor 28 can generate a controlling signal for stopping the gear crank 26, so as to block rotation of the holder 14 relative to the base 12 and to keep the holder 14 stable. In addition, the auxiliary gear 30, by the first trigger pin 301, can trigger the first sensor 28 to generate the controlling signal during each circle, and meanwhile, a prominent arc surface of the gear crank 26 can contact a sunken surface of the wheel 24 tightly, as shown in FIG. 3. A circle amount of the auxiliary gear 30, by the first trigger pin 301, capable of triggering the first sensor 28 to generate the controlling signal is designed according to an amount of the slots 241 on the wheel 24, and detail description is introduced as following.

For convenient analysis of rotation period between the wheel 24, the gear crank 26 and the auxiliary gear 30, a gear ratio of the auxiliary gear 30 to the gear crank 26 is 1 to 1. The gear crank 26 drives the wheel 24 to 60 degrees when rotating one round, and the auxiliary gear 30 engaged with the gear crank 26 can rotate the round synchronously, so that the first trigger pin 301 can periodically trigger the first sensor 28 to stop the rotation of the gear crank 26, when the rotation angle of the holder 14 relative to the base 12 had been adjusted. The wheel 24 further includes a sunken structure 242, and the gear crank 26 further includes a prominent arc structure 262. The prominent arc structure 262 can contact and slide relative to the sunken structure 242 when the gear crank 26 rotates at a specific angle, so as to prevent the holder 14 from vibration and to keep preferable print quality of the printer 10.

In addition, the rotary mechanism 16 can further include two second sensors 32 and a second trigger pin 34, selectively. The second sensors 32 can be respectively disposed on two ends on a surface of the base 12, and the second trigger pin 34 can be disposed on the bottom of the holder 14. When the holder 14 rotates relative to the base 12 at a predetermined angle, the second trigger pin 34 can trigger the corresponding second sensor 32 (which is according to a position of the second trigger pin 34 by the rotation of the holder 14) to generate a prompting signal with state information of the holder 14. For example, the second sensors 32*a* and 32*b* can be the optical interrupters, and the second trigger pin 34 can be the protrusion.

The gear crank 26 can be driven to synchronously rotate the wheel 24 and the auxiliary gear 30 for adjusting operation state of the printer 10. Because the six slots 241 are uniformly formed on the wheel 24 separately, and the gear ratio of the auxiliary gear 30 to the gear crank 26 is 1 to 1, the gear crank 26 can drive the auxiliary gear 30 to 360 degrees and drive the wheel 24 to 60 degrees when rotating a round, so as to rotate the holder 14 for the two-surface print. Furthermore, the actuating pin 261 of the gear crank 26 moves away from the slot 241 when the wheel 24 rotates to 180 degrees. The gear crank 26 keeps rotation even through the second sensor 32 is still triggered by the second trigger pin 34. The gear crank 26 can stop its rotation as the first sensor 28 is triggered by the first trigger pin 301, and complete the rotation of the holder 14 for the two-surface print.

Besides, the holder 14 can be a first state when the second sensor 32*a* is triggered by the second trigger pin 34, and the advance mechanism 18 can advance the first surface 221 of the web 22 to the print mechanism 20. Then, the auxiliary gear 30 and the gear crank 26 synchronously rotate three rounds to drive the wheel 24 to 180 degrees. After the half round of the holder 14 with the wheel 24, the holder 14 can be a second state when the second sensor 32*b* is triggered by the second trigger pin 34, so the advance mechanism 18 can advance the second surface 222 of the web 22 to the print mechanism 20, and the printer 10 of the present invention can rotate the holder 14 to print ink on the different surfaces of the web 22.

Figure 4:
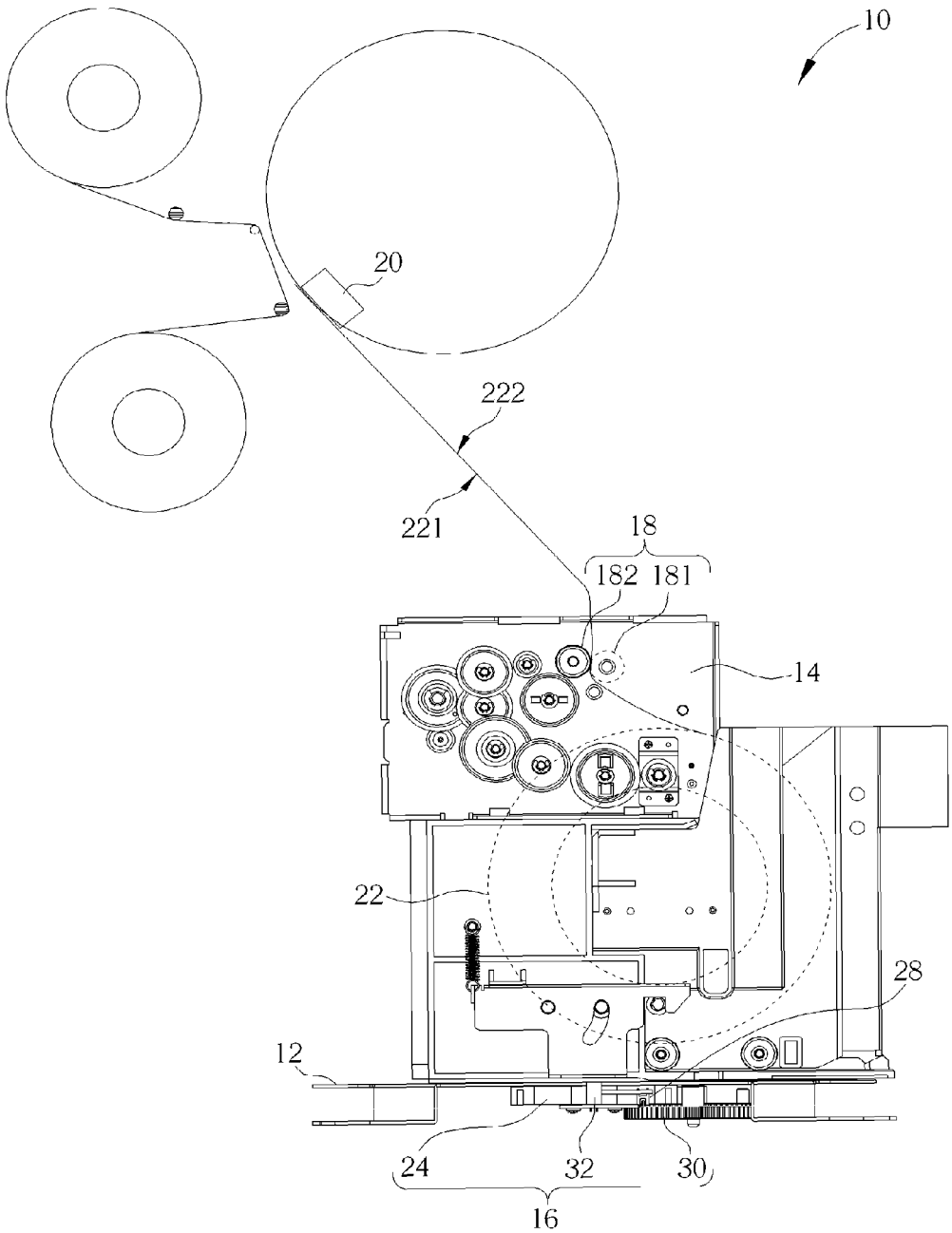
FIG. 4 is a diagram of the printer in a lateral view according to the embodiment of the present invention.

Please refer to FIG. 1 and FIG. 4. FIG. 4 is a diagram of the printer 10 after rotation in a lateral view according to the embodiment of the present invention. Comparing to the holder 14 shown in FIG. 1, the holder 14 shown in FIG. 4 has been rotated for the two-surface print. It should be mentioned that the advance mechanism 18 can include a pinch roller 181 and a feed roller 182. Functions of the pinch roller 181 and the feed roller 182 are for advancing the piece of paper from the web 22, and detail description is omitted herein for simplicity. The web 22 is heavy and the holder 14 has huge volume, a rotary center of the holder 14 can align with a tangent line between the pinch roller 181 and the feed roller 182 for stabilizing an advancing path of the printer 10. Therefore, the web 22 of the present invention keeps the same advancing path when the holder 14 rotates relative to the base 12 at the first state and at the second state, so as to effectively increase the two-surface print quality of the printer 10.

Comparing to the prior art, the printer of the present invention utilizes the rotary mechanism having the Geneva wheel to adjust the rotation angle of the holder relative to the base, so as to reverse the web for the two-surface print. In addition, the rotary mechanism of the present invention can utilize the arc structure of the gear crank to tightly contact the sunken structure of the wheel for increasing stability of the holder relative to the base, and can further utilize an assembly of the sensor and the trigger pin to detect the rotation angle of the holder, so as to provide functions of auto rotation control and active state information prompt.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A printer comprising:

a base;

a holder rotatably disposed on the base for holding a web; and a rotary mechanism for rotating the holder relative to the base, so as to print two surfaces of the web, the rotary mechanism comprising:

a wheel disposed on the holder, a plurality of slots being formed on the wheel;

a gear crank disposed on the base, the gear crank comprising an actuating pin, the actuating pin sliding into one of the slots when the gear crank rotates, so as to rotate the wheel;

a first sensor;

an auxiliary gear disposed on the base and engaged with the gear crank; and a first trigger pin disposed on the auxiliary gear, the first sensor being triggered to generate a controlling signal for stopping the gear crank by the first trigger pin when the auxiliary gear rotates by a predetermined angle.

2. The printer of claim 1, wherein the wheel is a Geneva wheel disposed on a bottom of the holder.

3. The printer of claim 1, wherein the first sensor is an optical interrupter.

4. The printer of claim 1, wherein a gear ratio of the auxiliary gear to the gear crank is 1 to 1.

5. The printer of claim 1, wherein the wheel comprises a sunken structure, the gear crank further comprises a prominent arc structure, and the prominent arc structure slides relative to the sunken structure.

6. The printer of claim 1, wherein the rotary mechanism further comprises:

a second sensor disposed on the base; and a second trigger pin disposed on a bottom of the holder, the second sensor being triggered to generate a prompting signal with state information of the holder by the second trigger pin when the holder rotates by a predetermined angle.

7. The printer of claim 6, wherein the second sensor is an optical interrupter.

8. The printer of claim 6, wherein the rotary mechanism further comprises a plurality of second sensors separately disposed on the base, and the second trigger pin triggers a corresponding second sensor to generate the prompting signal with the state information of the holder.

9. The printer of claim 1, wherein the printer further comprises an advance mechanism disposed above the holder for advancing the web, the advance mechanism comprises a pinch roller and a feed roller.

* * * * *